US011350711B1

(12) United States Patent
Selman

(10) Patent No.: US 11,350,711 B1
(45) Date of Patent: Jun. 7, 2022

(54) KNEE CURVE CANE APPARATUS

(71) Applicant: Terrence Selman, Brooklyn, NY (US)

(72) Inventor: Terrence Selman, Brooklyn, NY (US)

( * ) Notice: Subject to any disclaimer, the term of this patent is extended or adjusted under 35 U.S.C. 154(b) by 0 days.

(21) Appl. No.: 17/177,855

(22) Filed: Feb. 17, 2021

(51) Int. Cl.
*A45B 9/00* (2006.01)
*A45B 3/04* (2006.01)

(52) U.S. Cl.
CPC ..... *A45B 9/00* (2013.01); *A45B 3/04* (2013.01); *A45B 2009/007* (2013.01); *A45B 2200/05* (2013.01)

(58) Field of Classification Search
CPC ..... A45B 9/04; A45B 7/00; A45B 7/005
See application file for complete search history.

(56) References Cited

U.S. PATENT DOCUMENTS

| | | | | |
|---|---|---|---|---|
| 2,453,742 | A * | 11/1948 | Bowen | A61H 3/0288 403/220 |
| 4,790,339 | A * | 12/1988 | Bennett | A45B 7/00 135/65 |
| 5,495,867 | A | 3/1996 | Block | |
| 6,131,593 | A * | 10/2000 | Greene | A45B 9/04 135/77 |
| 6,216,713 | B1 | 4/2001 | Kennan | |
| 9,226,556 | B1 * | 1/2016 | Chien | A61H 3/0288 |
| 9,364,057 | B2 * | 6/2016 | Halonen | A45B 9/00 |
| 9,516,933 | B2 * | 12/2016 | Woodall | A45B 9/04 |
| 10,258,119 | B2 | 4/2019 | Cox | |
| 10,306,958 | B1 | 6/2019 | Oligie | |
| 10,561,567 | B2 * | 2/2020 | Lopez | A45B 9/04 |
| 10,631,600 | B2 * | 4/2020 | Moyo | A45B 3/02 |
| 10,729,213 | B2 * | 8/2020 | FitzPatrick | A45B 7/005 |
| 10,881,175 | B2 * | 1/2021 | Demeo | A45B 9/02 |
| 2006/0090783 | A1 | 5/2006 | King-Fai | |
| 2010/0101615 | A1 * | 4/2010 | Lisenby | A61H 3/02 135/65 |
| 2010/0313925 | A1 * | 12/2010 | Jiang | A45B 9/04 135/82 |
| 2011/0240077 | A1 | 10/2011 | Doherty | |
| 2016/0278490 | A1 | 9/2016 | Rieker | |
| 2016/0316869 | A1 * | 11/2016 | Byrd | A45B 9/02 |
| 2019/0328091 | A1 | 10/2019 | Lumley | |

FOREIGN PATENT DOCUMENTS

| | | |
|---|---|---|
| WO | WO2006042458 | 4/2006 |

* cited by examiner

*Primary Examiner* — Noah Chandler Hawk

(57) ABSTRACT

A knee curve cane apparatus for ease of use and safety includes a handle and an upper shaft segment coupled to the handle. The upper shaft segment has an upper top end coupled to the handle. A medial top end of a medial shaft segment is coupled to an upper bottom end of the upper shaft segment. The medial shaft segment is curved and configured to accommodate a user's knee to prevent contact while walking. A medial bottom end of the medial shaft segment is vertically aligned with the medial top end. A lower shaft segment is coupled to the medial shaft segment. A lower top end of the lower shaft segment is coupled to the medial bottom end. A base collar of a base is selectively engaged with a lower bottom end of the lower shaft segment.

9 Claims, 4 Drawing Sheets

KNEE CURVE CANE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to walking assistance devices and more particularly pertains to a new walking assistance device for ease of use and safety. The present device includes a curved portion to accommodate the user's knee as steps are taken. There may also be interchangeable pronged tips for improved grip in slippery conditions.

(2) Description of Related Art Including Information Disclosed Under 37 CFR 1.97 and 1.98

The prior art relates to walking assistance devices. These devices are typically straight at knee height. Known devices also lack a swiveling medial portion and a plurality of lights along the shaft. Existing walking assistance devices also lack an interchangeable multi-pronged tip for added security in slippery conditions.

BRIEF SUMMARY OF THE INVENTION

An embodiment of the disclosure meets the needs presented above by generally comprising a handle and an upper shaft segment coupled to the handle. The upper shaft segment has an upper top end coupled to the handle. A medial shaft segment is coupled to the upper shaft segment. A medial top end of the medial shaft segment is coupled to an upper bottom end of the upper shaft segment. The medial shaft segment is curved and configured to accommodate a user's knee to prevent contact while walking. A medial bottom end of the medial shaft segment is vertically aligned with the medial top end. A lower shaft segment is coupled to the medial shaft segment. A lower top end of the lower shaft segment is coupled to the medial bottom end. A base is coupled to the lower shaft segment. The base has a base collar selectively engaged with a lower bottom end of the lower shaft segment.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
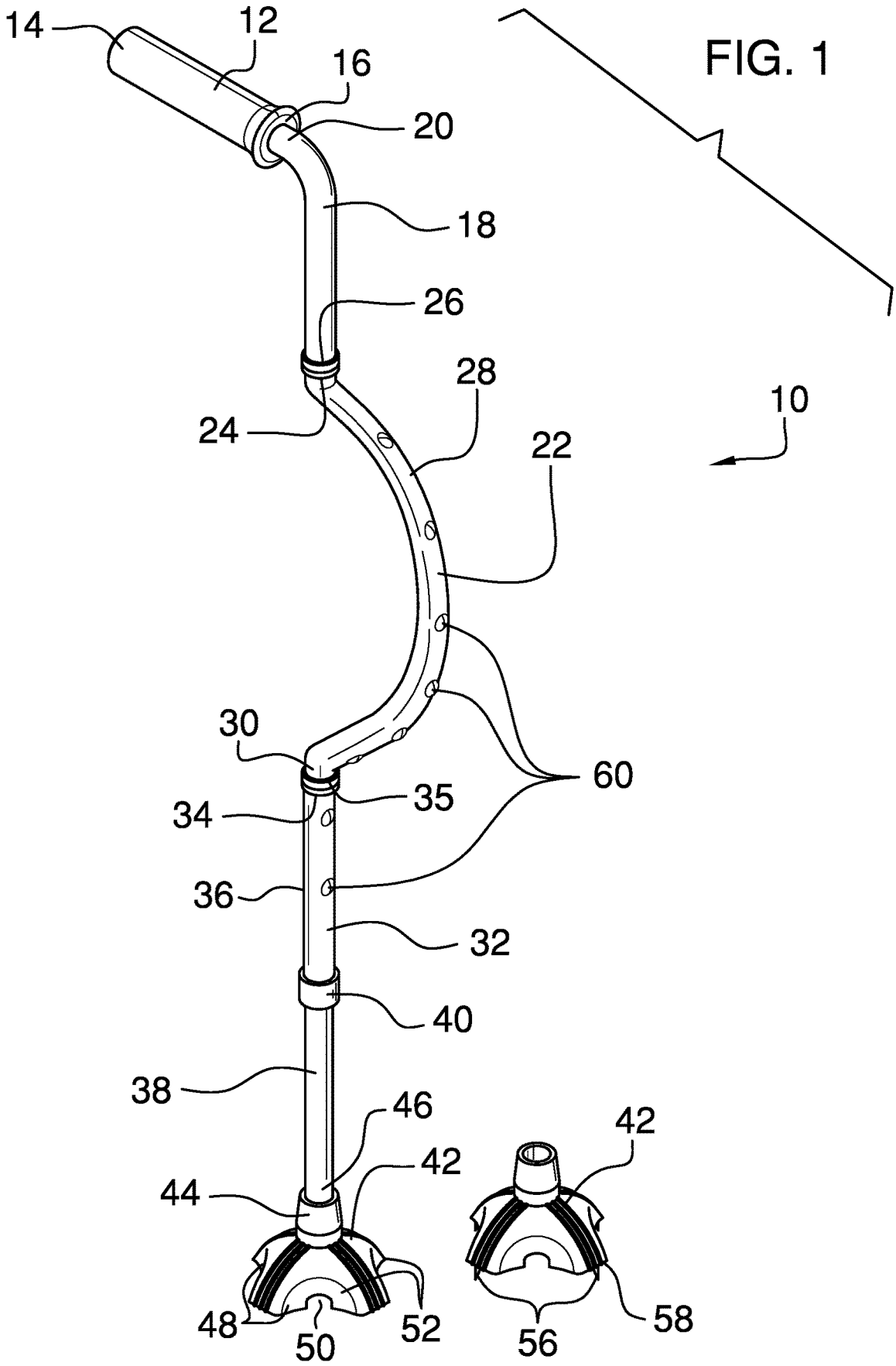
FIG. 1 is an isometric view of a knee curve cane apparatus according to an embodiment of the disclosure.
Figure 2:
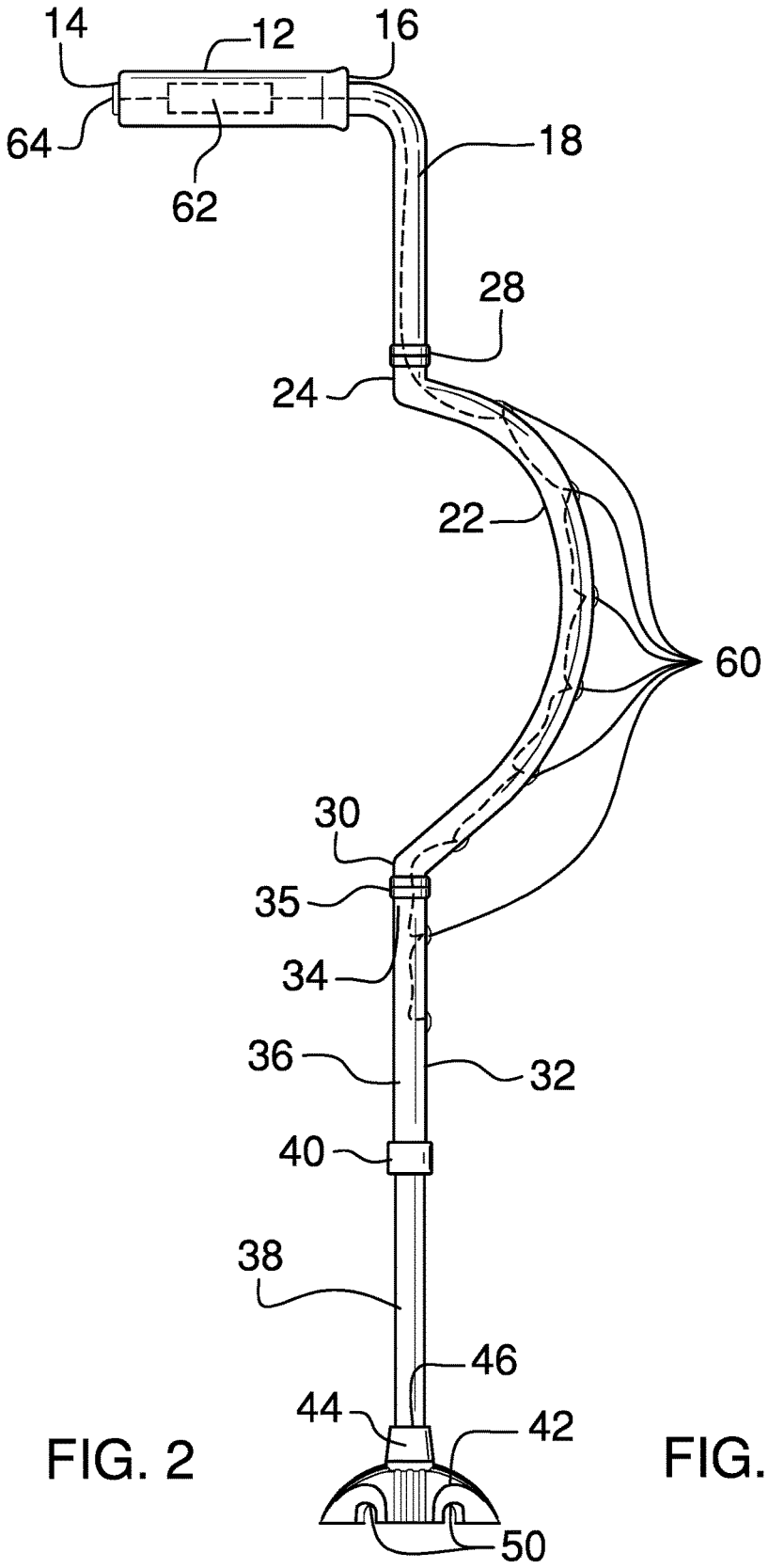
FIG. 2 is a side elevation view of an embodiment of the disclosure.
Figure 3:
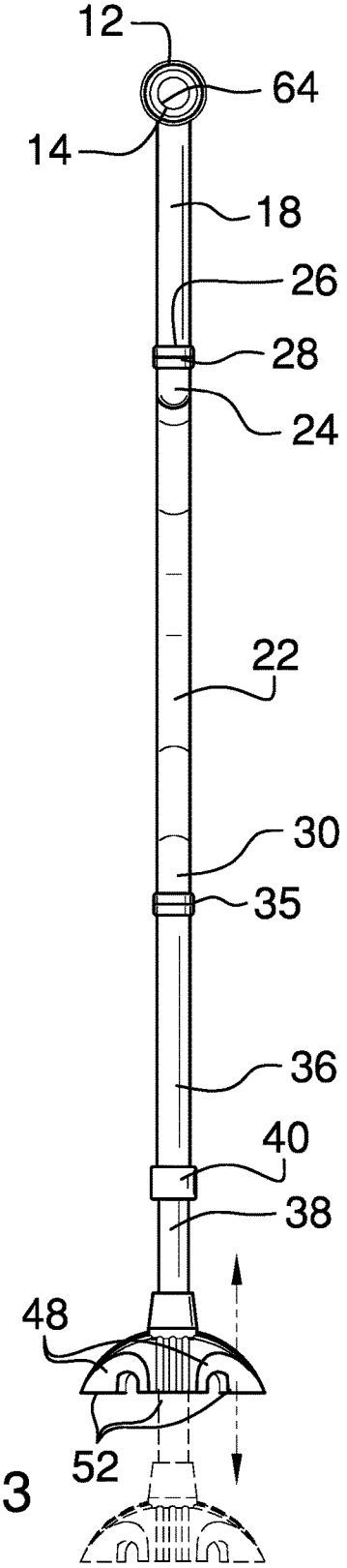
FIG. 3 is a rear elevation view of an embodiment of the disclosure.
Figure 4:
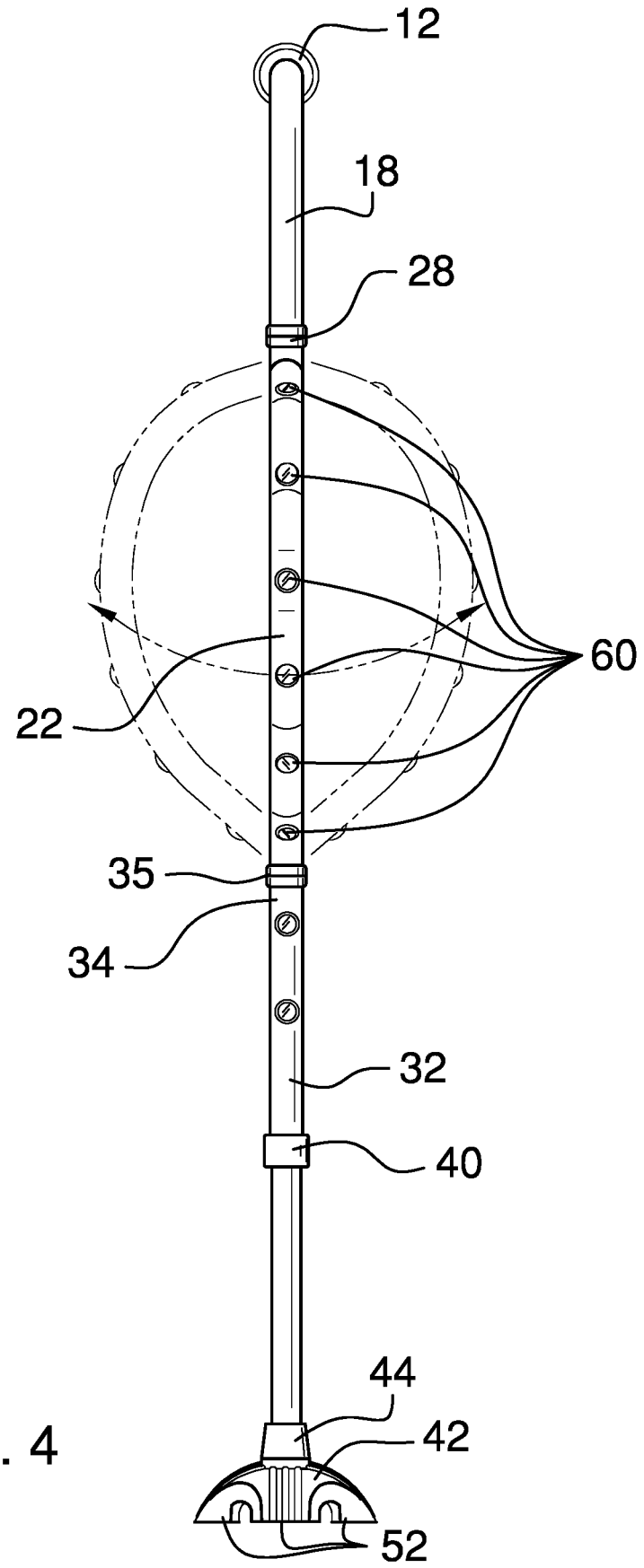
FIG. 4 is a front elevation view of an embodiment of the disclosure.

With reference now to the drawings, and in particular to FIGS. 1 through 5 thereof, a new walking assistance device embodying the principles and concepts of an embodiment of the disclosure and generally designated by the reference numeral 10 will be described.

As best illustrated in FIGS. 1 through 6, the knee curve cane apparatus 10 generally comprises a handle 12. The handle 12 may be horizontal and has a handle back end 14 and a handle front end 16. The handle front end 16 may be flared to prevent the user's hand from sliding forward.

Figure 5:
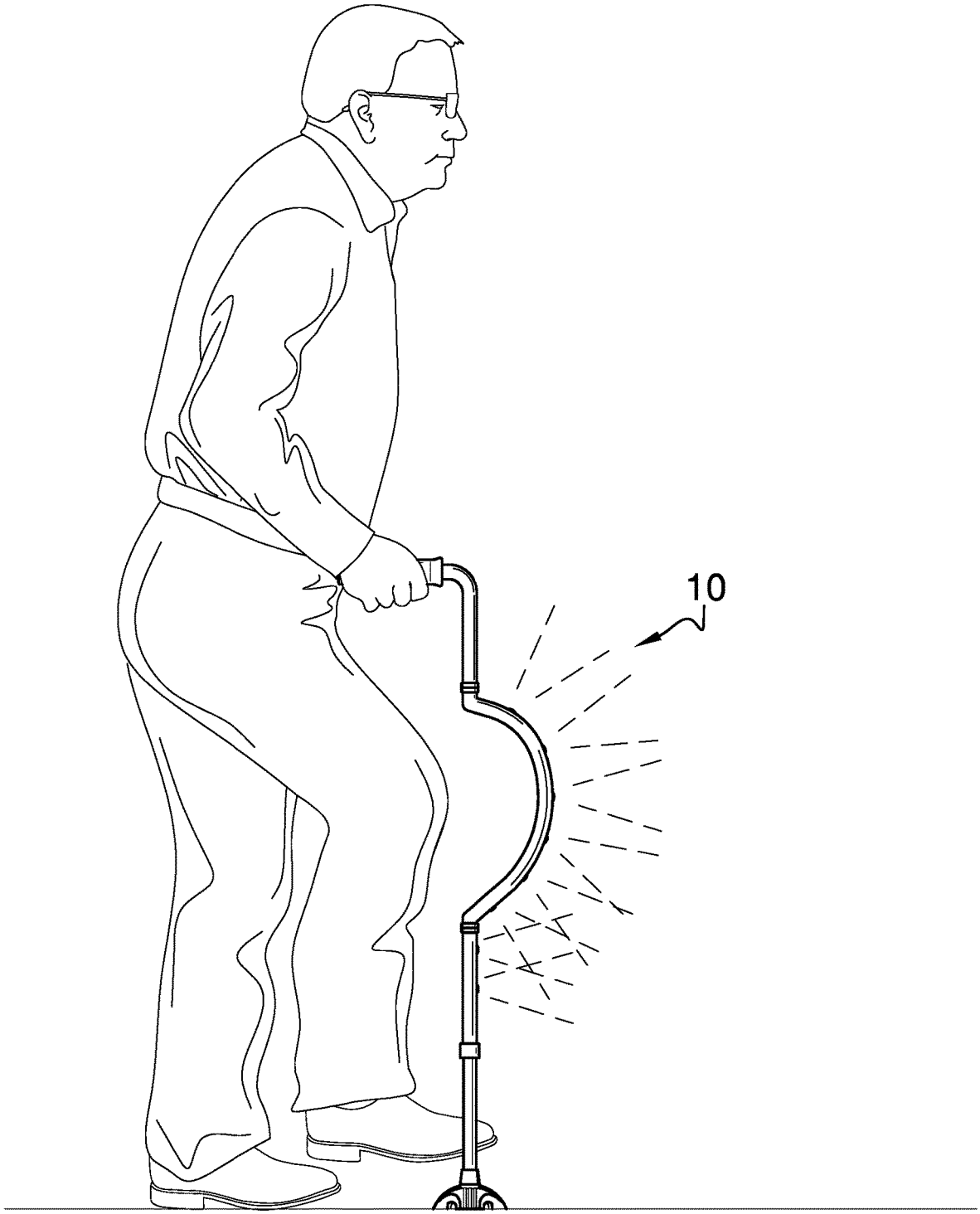
FIG. 5 is an in-use view of an embodiment of the disclosure.

An upper shaft segment 18 is coupled to the handle 12. An upper top end 20 of the upper shaft segment is coupled to the handle front end 16 and curves 90° downwards. A medial shaft segment 22 is coupled to the upper shaft segment 18. A medial top end 24 of the medial shaft segment is coupled to an upper bottom end 26 of the upper shaft segment. The medial top end 24 may be pivotably coupled to the upper bottom end 26 at a first swivel joint 28. The medial shaft segment 22 is curved and configured to accommodate a user's knee to prevent contact while walking as shown in FIG. 5. A medial bottom end 30 of the medial shaft segment is vertically aligned with the medial top end 24 to maximize for structural strength and stability.

A lower shaft segment 32 is coupled to the medial shaft segment 22. A lower top end 34 of the lower shaft segment 32 is coupled to the medial bottom end 30. The lower top end 34 may be pivotably coupled to the medial bottom end 30 at a second swivel joint 35. The medial shaft segment 22 can thus remain facing forward while the upper shaft segment 18 and the lower shaft segment 32 pivot during use.

The lower shaft segment 32 may have a lower top section 36 and a lower bottom section 38 telescopably coupled within the lower top section 36. An adjustment ring 40 can be twisted to fix or release the length of the lower shaft segment 32 to adjust the overall height of the apparatus 10 and appropriately position the medial shaft segment 22 in front of the user's knee.

A base 42 is coupled to the lower shaft segment 32. The base 42 has a base collar 44 selectively engaged with a lower bottom end 46 of the lower shaft segment. The base may be hemispherical and has a plurality of four cutouts 48 and a pair of cross channels 50 to define a set of four feet 52. An alternate interchangeable base 54 may have a plurality of prongs 56 extending from a foot underside 58 of each of the feet for added grip in slippery environments.

A plurality of lights 60 is coupled to the medial shaft segment 22 and the lower shaft segment 32. The plurality of lights 60 may be evenly spaced along the medial shaft segment 22 to provide varied vertical lighting direction. A battery 62 is coupled within the handle 12 and is in operational communication with the plurality of lights 60. A power button 64 is coupled to the handle 12 and is in operational communication with the battery 62 to activate the plurality of lights 60. The power button 64 may be coupled to the handle back end 14 to prevent accidental activation.

In use, the lower shaft segment 32 is adjusted to place the medial shaft segment 22 at knee height. The user then secures the apparatus 10 by the handle 12 for use like a traditional cane. As needed the plurality of lights 60 is activated with the power button 62.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A knee curve cane apparatus comprising:

a handle;

an upper shaft segment coupled to the handle, the upper shaft segment having an upper top end coupled to the handle;

a medial shaft segment coupled to the upper shaft segment, a medial top end of the medial shaft segment being coupled to an upper bottom end of the upper shaft segment, the medial shaft segment being curved and configured to accommodate a user's knee to prevent contact while walking, a medial bottom end of the medial shaft segment being vertically aligned with the medial top end the medial top end being pivotably coupled to the upper bottom end at a first swivel joint wherein the medial shaft segment is swivelable about an axis collinear with a central longitudinal axis of the upper shaft segment;

a lower shaft segment coupled to the medial shaft segment, a lower top end of the lower shall segment being coupled to the medial bottom end; and a base coupled to the lower shaft segment, the base having a base collar selectively engaged with a lower bottom end of the lower shaft segment.

2. The knee curve cane apparatus of claim 1 further comprising the handle being horizontal and having a handle back end and a handle front end; the upper top end of the upper shaft segment being coupled to the handle front end and curving 90° downwards.

3. The knee curve cane apparatus of claim 1 further comprising a plurality of lights coupled to the medial shaft segment and the lower shall segment; a battery coupled within the handle, the battery being in operational communication with the plurality of lights; and a power button coupled to the handle, the power button being in operational communication with the battery.

4. The knee curve cane apparatus of claim 1 further comprising the lower top end being pivotably coupled to the medial bottom end at a second swivel joint.

5. The knee curve cane apparatus of claim 1 further comprising the lower shaft segment having a lower top section and a lower bottom section telescopably coupled within the lower top section.

6. The knee curve cane apparatus of claim 1 further comprising the base having a plurality of feet.

7. The knee curve cane apparatus of claim 1 further comprising the base being hemispherical and having a plurality of four cutouts and a pair of cross channels to define a set of four feet.

8. The knee curve cane apparatus of claim 7 further comprising the base having a plurality of prongs extending from a foot underside of each of the feet.

9. A knee curve cane apparatus comprising:

a handle, the handle being horizontal and having a handle back end and a handle front end;

an upper shaft segment coupled to the handle, an upper top end of the upper shaft segment being coupled to the handle front end and curving 90° downwards;

a medial shaft segment coupled to the upper shaft segment, a medial top end of the medial shaft segment being coupled to an upper bottom end of the upper shaft segment, the medial top end being pivotably coupled to the upper bottom end at a first swivel joint wherein the medial shaft segment is swivelable about an axis collinear with a central longitudinal axis of the upper shaft segment, the medial shaft segment being curved and configured to accommodate a user's knee to prevent contact while walking, a medial bottom end of the medial shaft segment being vertically aligned with the medial top end;

a lower shaft segment coupled to the medial shaft segment, a lower top end of the lower shaft segment being coupled to the medial bottom end, the lower top end being pivotably coupled to the medial bottom end at a second swivel joint, the lower shaft segment having a lower top section and a lower bottom section telescopably coupled within the lower top section;

a base coupled to the lower shaft segment, the base having a base collar selectively engaged with a lower bottom end of the lower shaft segment, the base being hemispherical and having a plurality of four cutouts and a pair of cross channels to define a set of four feet, the base having a plurality of prongs extending from a foot underside of each of the feet;

a plurality of lights coupled to the medial shaft segment and the lower shaft segment;

a battery coupled within the handle, the battery being in operational communication with the plurality of lights; and a power button coupled to the handle, the power button being in operational communication with the battery.

* * * * *